US010313805B2

(12) United States Patent
Fitz

(10) Patent No.: US 10,313,805 B2
(45) **Date of Patent: *Jun. 4, 2019**

(54) BINAURALLY COORDINATED FREQUENCY TRANSLATION IN HEARING ASSISTANCE DEVICES

(71) Applicant: Starkey Laboratories, Inc., Eden Prairie, MN (US)

(72) Inventor: Kelly Fitz, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/837,564

(22) Filed: Dec. 11, 2017

(65) Prior Publication Data

US 2018/0103328 A1 Apr. 12, 2018

Related U.S. Application Data

(63) Continuation of application No. 14/866,678, filed on Sep. 25, 2015, now Pat. No. 9,843,875.

(51) Int. Cl.
*H04R 25/00* (2006.01)

(52) U.S. Cl.
CPC ..... *H04R 25/552* (2013.01); *H04R 25/505* (2013.01); *H04R 25/70* (2013.01);
(Continued)

(58) Field of Classification Search
CPC .... H04R 25/552; H04R 25/35; H04R 25/353; H04R 25/407; H04R 25/505; H04R 2225/43; H04R 2225/55
(Continued)

(56) References Cited

U.S. PATENT DOCUMENTS 4,051,331 A 9/1977 Strong et al.
5,014,319 A 5/1991 Leibman
(Continued)

FOREIGN PATENT DOCUMENTS

EA WO-2007000161 A1 1/2007
EP 2099235 A2 9/2009
(Continued)

OTHER PUBLICATIONS

"U.S. Appl. No. 12/043,827, Notice of Allowance dated Jun. 10, 2011", 6 pgs.

(Continued)

*Primary Examiner* — Disler Paul
(74) *Attorney, Agent, or Firm* — Schwegman Lundberg & Woessner, P.A.

(57) ABSTRACT

Disclosed herein, among other things, are apparatus and methods for a binaurally coordinated frequency translation for hearing assistance devices. In various method embodiments, an audio input signal is received at a first hearing assistance device for a wearer. The audio input signal is analyzed and a first set of target parameters is calculated. A third set of target parameters is derived from the first set and a second set of calculated target parameters received from a second hearing assistance device using a programmable criteria, and frequency lowered auditory cues are generated using the third set of target parameters. The derived third set of target parameters is used in both the first hearing assistance device and the second hearing assistance device for binaurally coordinated frequency lowering.

20 Claims, 2 Drawing Sheets

(52) U.S. Cl.
CPC ..... *H04R 25/35* (2013.01); *H04R 25/353* (2013.01); *H04R 2225/021* (2013.01); *H04R 2225/023* (2013.01); *H04R 2225/025* (2013.01); *H04R 2225/43* (2013.01); *H04R 2225/55* (2013.01)

(58) Field of Classification Search
USPC ..... 381/59–60, 312, 313, 320–321, 23.1, 381/316–317
See application file for complete search history.

(56) References Cited

U.S. PATENT DOCUMENTS

| | | | | |
|---|---|---|---|---|
| 5,771,299 | A | 6/1998 | Melanson | |
| 6,169,813 | B1 | 1/2001 | Richardson et al. | |
| 6,240,195 | B1 | 5/2001 | Bindner et al. | |
| 6,577,739 | B1 | 6/2003 | Hurtig et al. | |
| 6,980,665 | B2 | 12/2005 | Kates | |
| 7,146,316 | B2 | 12/2006 | Alves | |
| 7,248,711 | B2 | 7/2007 | Allegro et al. | |
| 7,580,536 | B2 | 8/2009 | Carlile et al. | |
| 7,757,276 | B1 | 7/2010 | Lear | |
| 8,000,487 | B2 | 8/2011 | Fitz et al. | |
| 8,073,171 | B2 * | 12/2011 | Haenggi ..... | H04R 5/033 381/23.1 |
| 8,351,626 | B2 | 1/2013 | Hersbach et al. | |
| 8,503,704 | B2 | 8/2013 | Francart et al. | |
| 8,526,650 | B2 | 9/2013 | Fitz | |
| 8,761,422 | B2 | 6/2014 | Fitz et al. | |
| 8,787,605 | B2 | 7/2014 | Fitz | |
| 9,031,271 | B2 | 5/2015 | Pontoppidan | |
| 9,060,231 | B2 | 6/2015 | Fitz | |
| 9,167,366 | B2 | 10/2015 | Valentine et al. | |
| 9,843,875 | B2 | 12/2017 | Fitz | |
| 2003/0112987 | A1 | 6/2003 | Nordqvist et al. | |
| 2004/0234079 | A1 | 11/2004 | Schneider et al. | |
| 2004/0264721 | A1 | 12/2004 | Allegro et al. | |
| 2006/0247922 | A1 | 11/2006 | Hetherington et al. | |
| 2006/0247992 | A1 | 11/2006 | Hetherington et al. | |
| 2006/0253209 | A1 | 11/2006 | Hersbach et al. | |
| 2008/0215330 | A1 | 9/2008 | Haram et al. | |
| 2009/0226016 | A1 | 9/2009 | Fitz | |
| 2010/0067721 | A1 | 3/2010 | Tiefenau | |
| 2010/0284557 | A1 | 11/2010 | Fitz | |
| 2011/0249843 | A1 | 10/2011 | Holmberg et al. | |
| 2012/0177236 | A1 | 7/2012 | Fitz et al. | |
| 2013/0030800 | A1 | 1/2013 | Tracey et al. | |
| 2013/0051565 | A1 * | 2/2013 | Pontoppidan ..... | H04R 25/353 381/23.1 |
| 2013/0051566 | A1 | 2/2013 | Pontoppidan | |
| 2013/0101123 | A1 | 4/2013 | Hannemann | |
| 2013/0208896 | A1 * | 8/2013 | Chatlani ..... | H04R 25/407 381/17 |
| 2013/0243227 | A1 | 9/2013 | Kinsbergen et al. | |
| 2013/0336509 | A1 | 12/2013 | Fitz | |
| 2014/0119583 | A1 | 5/2014 | Valentine et al. | |
| 2014/0169600 | A1 | 6/2014 | Fitz | |
| 2014/0288938 | A1 | 9/2014 | Kong | |
| 2015/0036853 | A1 | 2/2015 | Solum et al. | |
| 2015/0124975 | A1 * | 5/2015 | Pontoppidan ..... | H04R 25/552 381/23.1 |
| 2016/0302014 | A1 | 10/2016 | Fitz et al. | |
| 2017/0094424 | A1 | 3/2017 | Fitz | |
| 2017/0156009 | A9 * | 6/2017 | Natarajan ..... | H04R 25/453 |

FOREIGN PATENT DOCUMENTS

| | | | |
|---|---|---|---|
| EP | 1959713 | B1 | 10/2009 |
| EP | 2249587 | A2 | 11/2010 |
| EP | 2375782 | A1 | 10/2011 |
| WO | WO-0075920 | A1 | 12/2000 |
| WO | WO-2007010479 | A2 | 1/2007 |
| WO | WO-2007135198 | A2 | 11/2007 |
| WO | WO-2013067145 | A1 | 5/2013 |

OTHER PUBLICATIONS

"U.S. Appl. No. 12/774,356, Non Final Office Action dated Aug. 16, 2012", 6 pgs.
"U.S. Appl. No. 12/774,356, Notice of Allowance dated Jan. 8, 2013", 5 pgs.
"U.S. Appl. No. 12/774,356, Notice of Allowance dated May 1, 2013", 6 pgs.
"U.S. Appl. No. 12/774,356, Response filed Dec. 17, 2012 to Non Final Office Action dated Aug. 16, 2012", 8 pgs.
"U.S. Appl. No. 13/208,023, Final Office Action dated Nov. 25, 2013", 5 pgs.
"U.S. Appl. No. 13/208,023, Non Final Office Action dated May 29, 2013", 5 pgs.
"U.S. Appl. No. 13/208,023, Notice of Allowance dated Feb. 10, 2014", 5 pgs.
"U.S. Appl. No. 13/208,023, Response filed Jan. 27, 2014 to Final Office Action dated Nov. 23, 2013", 7 pgs.
"U.S. Appl. No. 13/208,023, Response filed Sep. 30, 2013 to Non Final Office Action dated May 29, 2013", 6 pgs.
"U.S. Appl. No. 13/916,392, Notice of Allowance dated Mar. 14, 2014", 9 pgs.
"U.S. Appl. No. 13/916,392, Notice of Allowance dated Nov. 27, 2013", 12 pgs.
"U.S. Appl. No. 13/931,436, Non Final Office Action dated Dec. 10, 2014", 8 pgs.
"U.S. Appl. No. 13/931,436, Notice of Allowance dated Jun. 8, 2015", 8 pgs.
"U.S. Appl. No. 13/931,436, Response filed Mar. 10, 2015 to Non Final Office Action dated Dec. 10, 2014", 7 pgs.
"U.S. Appl. No. 14/017,093, Non Final Office Action dated Oct. 20, 2014", 5 pgs.
"U.S. Appl. No. 14/017,093, Notice of Allowance dated Feb. 10, 2015", 8 pgs.
"U.S. Appl. No. 14/017,093, Preliminary Amendment Filed Jul. 9, 2014", 6 pgs.
"U.S. Appl. No. 14/017,093, Response filed Jan. 20, 2015 to Non Final Office Action dated Oct. 20, 2014", 7 pgs.
"U.S. Appl. No. 14/866,678, Final Office Action dated May 2, 2017", 15 pgs.
"U.S. Appl. No. 14/866,678, Non Final Office Action dated Jan. 20, 2017", 13 pgs.
"U.S. Appl. no. 14/866,678, Notice of Allowance dated Aug. 9, 2017", 8 pgs.
"U.S. Appl. No. 14/866,678, Response filed Apr. 20, 2017 to Non Final Office Action dated Jan. 20, 2017", 10 pgs.
"U.S. Appl. No. 14/866,678, Response filed Aug. 1, 2017 to Final Office Action dated May 2, 2017", 9 pgs.
"U.S. Appl. No. 15/092,487, Final Office Action dated Oct. 25, 2017", 11 pgs.
"U.S. Appl. no. 15/092,487, Non Final Office Action dated May 5, 2017", 8 pgs.
"U.S. Appl. No. 15/092,487, Response filed Aug. 7, 2017 to Non Final Office Action dated May 5, 2017", 7 pgs.
"European Application No. 09250638.5, Summons to Attend Oral Proceedings dated Jun. 20, 2016", 6 pgs.
"European Application Serial No. 09250638.5, Amendment filed Aug. 22, 2012", 15 pgs.
"European Application Serial No. 09250638.5, Extended Search Report dated Jan. 20, 2012", 8 pgs.
"European Application Serial No. 09250638.5, Office Action dated Sep. 25, 2013", 5 pgs.
"European Application Serial No. 09250638.5, Response filed Feb. 4, 2014 to Office Action dated Sep. 25, 2013", 8 pgs.
"European Application Serial No. 10250883.5, Amendment filed Aug. 22, 2012", 16 pgs.
"European Application Serial No. 10250883.5, Extended European Search Report dated Jan. 23, 2012", 8 pgs.
"European Application Serial No. 10250883.5, Office Action dated Sep. 25, 2013", 6 pgs.
"European Application Serial No. 10250883.5, Response filed Feb. 4, 2014 to Office Action dated Sep. 25, 2013", 2 pgs.

(56) References Cited

OTHER PUBLICATIONS

"European Application Serial No. 10250883.5, Summons to Attend Oral Proceedings dated Jun. 28, 2016", 6 pgs.
"European Application Serial No. 13172173.0, Response filed Aug. 30, 2016 to Communication Pursuant to Article 94(3) EPC dated Mar. 4, 2016", 8 pgs.
"European Application Serial No. 13172173.0, Communication Pursuant to Article 94(3) EPC dated Mar. 4, 2016", 7 pgs.
"European Application Serial No. 13172173.0, Extended European Search Report dated Apr. 9, 2015", 9 pgs.
"European Application Serial No. 13172173.0, Office Action dated May 11, 2015", 2 pgs.
"European Application Serial No. 13172173.0, Response filed Nov. 6, 2015 to Extended European Search Report dated Apr. 9, 2015", 27 pgs.
"European Application Serial No. 16164478.6, Communication Pursuant to Article 94(3) EPC dated May 16, 2017", 3 pgs.
"European Application Serial No. 16164478.6, Extended European Search Report dated Aug. 10, 2016", 8 pgs.
"European Application Serial No. 16164478.6, Response filed Apr. 12, 2017 to Extended European Search Report dated Aug. 10, 2016", 12 pgs.
"European Application Serial No. 16164478.6, Response filed Sep. 26, 2017 to Communication Pursuant to Article 94(3) EPC dated May 16, 2017", 38pgs.
"European Application Serial No. 16190386.9, Partial European Search Report dated Feb. 15, 2017", 7 pgs.
Alexander, Joshua, "Frequency Lowering in Hearing Aids", ISHA Convention, (2012), 24 pgs.
Assmann, Peter F., et al., "Modeling the Perception of Frequency-Shifted Vowels", ICSLP 2002 : 7th International Conference on Spoken Language Processing. Denver, Colorado, [International Conference on Spoken Language Processing. (ICSLP)], Adelaide : Causal Productions, AU, XP007O11577, ISBN: 978-1-876346-40-9, (Sep. 16, 2002), 4 pgs.
Chen, J., et al., "A Feature Study for Classification-Based Speech Separation at Low Signal-to-Noise Ratios", IEEE/ACM Trans. Audio Speech Lang. Process., 22, (2014), 1993-2002.
Fitz, Kelly, et al., "A New Algorithm for Bandwidth Association in Bandwidth-Enhanced Additive Sound Modeling", International Computer Music Conference Proceedings, (2000), 4 pgs.
Fitz, Kelly Raymond, "The Reassigned Bandwidth-Enhanced Method of Additive Synthesis", (1999), 163 pgs.
Healy, Eric W., et al, "An algorithm to improve speech recognition in noise for hearing-impaired listeners", Journal of the Acoustical Society of America, 134, (2013), 3029-3038.
Hermansen, K., et al., "Hearing aids for profoundly deaf people based on a new parametric concept", Applications of Signal Processing to Audio and Acoustics, 1993; Final Program and Paper Summaries, 1993, IEEE Workshop on vol., Iss. Oct. 17-20, 1993, (Oct. 1993), 89-92.
Kong, Ying-Yee, et al., "On the development of a frequency-lowering system that enhances place-of-articulation perception", Speech Commun., 54(1), (Jan. 1, 2012), 147-160.
Kuk, F., et al., "Linear Frequency Transposition: Extending the Audibility of High-Frequency Information", Hearing Review, (Oct. 2006), 5 pgs.
Makhoul, John, "Linear Prediction: A Tutorial Review", Proceedings of the IEEE, 63, (Apr. 1975), 561-580.
McDermott, H., et al., "Preliminary results with the AVR ImpaCt frequency-transposing hearing aid", J Am Acad Audiol., 12(3), (Mar. 2001), 121-127.
McDermottt, H., et al, "Improvements in speech perception with use of the AVR TranSonic frequency-transposing hearing aid.", Journal of Speech, Language, and Hearing Research, 42(6), (Dec. 1999), 1323-1335.
McLoughlin, Ian Vince, et al., "Line spectral pairs", Signal Processing, Elsevier Science Publisher B.V. Amsterdam, NL, vol. 88. No. 3, (Nov. 14, 2007), 448-467.
Posen, M. P , et al., "Intelligibility of frequency-lowered speech produced by a channel vocoder", J Rehabil Res Dev., 30(1), (1993), 26-38.
Risberg, A., "A critical review of work on speech analyzing hearing aids", IEEE Transactions on Audio and Electroacoustics, 17(4), (1969), 290-297.
Roch, et al., "Foreground auditory scene analysis for hearing aids", Pattern Recognition Letters, Elsevier, Amsterdam, NL, vol. 28, No. 11, XP022099041, ISSN: 0167-865579,, (Aug. 1, 2007), 1351-1359.
Sekimoto, Sotaro, et al., "Frequency Compression Techniques of Speech Using Linear Prediction Analysis-Synthesis Scheme", Ann Bull RILP, vol. 13, (Jan. 1, 1979), 133-136.
Simpson, A., et al., "Improvements in speech perception with an experimental nonlinear frequency compression hearing device", Int J Audiol., vol. 44(5), (May 2005), 281-292.
Turner, C. W., et al., "Proportional frequency compression of speech for listeners with sensorineural hearing loss", J Acoust Soc Am., vol. 106(2), (Aug. 1999), 877-86.
"U.S. Appl. No. 15/092,487, Advisory Action dated Jan. 22, 2018", 4 pgs.
"U.S. Appl. No. 15/092,487, Non Final Office Action dated Feb. 21, 2018", 11 pgs.
"U.S. Appl. No. 15/092,487, Response filed Dec. 22, 2017 to Final Office Action dated Oct. 25, 2017", 8 pgs.
"European Application Serial No. 13172173.0, Summons to Attend Oral Proceedings dated Dec. 15, 2017", 10 pgs.
"U.S. Appl. No. 15/092,487, Response Filed May 17, 2018 to Non Final Office Action dated Feb. 21, 2018", 8 pgs.
"U.S. Appl. No. 15/092,487, Final Office Action dated Aug. 29, 2018", 10 pgs.

* cited by examiner

BINAURALLY COORDINATED FREQUENCY TRANSLATION IN HEARING ASSISTANCE DEVICES

CROSS-REFERENCE TO RELATED APPLICATION

This application is a continuation of U.S. patent application Ser. No. 14/866,678, filed Sep. 25, 2015, now issued as U.S. Pat. No. 9,843,875, which is incorporated by reference herein in its entirety.

RELATED APPLICATIONS

The present application is related to U.S. patent application Ser. No. 12/043,827 filed on Mar. 6, 2008 now issued as U.S. Pat. No. 8,000,487, and U.S. patent application Ser. No. 13/931,436 filed on Jun. 28, 2013, now issued as U.S. Pat. No. 9,167,366, which are hereby incorporated herein by reference in their entirety.

TECHNICAL FIELD

This document relates generally to hearing assistance systems and more particularly to binaurally coordinated frequency translation for hearing assistance devices.

BACKGROUND

Hearing assistance devices, such as hearing aids, are used to assist patient's suffering hearing loss by transmitting amplified sounds to ear canals. In one example, a hearing aid is worn in and/or around a patient's ear. Hearing aids are intended to restore audibility to the hearing impaired by providing gain at frequencies at which the patient exhibits hearing loss. In order to obtain these benefits, hearing-impaired individuals must have residual hearing in the frequency regions where amplification occurs. In the presence of"dead regions", where there is no residual hearing, or regions in which hearing loss exceeds the hearing aid's gain capabilities, amplification will not benefit the hearing-impaired individual.

Individuals with high-frequency dead regions cannot hear and indentify speech sounds with high-frequency components. Amplification in these regions will cause distortion and feedback. For these listeners, moving high-frequency information to lower frequencies could be a reasonable alternative to over amplification of the high frequencies. Frequency translation (FT) algorithms are designed to provide high-frequency information by lowering these frequencies to the lower regions. The motivation is to render audible sounds that cannot be made audible using gain alone.

There is a need in the art for improved binaurally coordinated frequency translation for hearing assistance devices.

SUMMARY

Disclosed herein, among other things, are apparatus and methods for a binaurally coordinated frequency translation for hearing assistance devices. In various method embodiments, an audio input signal is received at a first hearing assistance device for a wearer. The audio input signal is analyzed, characteristics of the audio input signal are identified, and a first set of target parameters is calculated for frequency lowered cues from the characteristics. The first set of calculated target parameters is transmitted from the first hearing assistance device to a second hearing assistance device, and a second set of calculated target parameters is received at the first hearing assistance device from the second hearing assistance device. A third set of target parameters is derived from the first set and the second set of calculated target parameters using a programmable criteria, and frequency lowered auditory cues are generated using the derived third set of target parameters. The derived third set of target parameters is used in both the first hearing assistance device and the second hearing assistance device for binaurally coordinated frequency lowering.

Various aspects of the present subject matter include a system for binaurally coordinated frequency translation for hearing assistance devices. Various embodiments of the system include a first hearing assistance device configured to be worn in or on a first ear of a wearer, and a second hearing assistance device configured to be worn in a second ear of the wearer. The first hearing assistance device includes a processor programmed to receive an audio input signal, analyze the audio input signal, and identify characteristics of the audio input signal, calculate a first set of target parameters for frequency lowered cues from the characteristics, transmit the first set of calculated target parameters from the first hearing assistance device to the second hearing assistance device, receive a second set of calculated target parameters at the first hearing assistance device from the second hearing assistance device, derive a third set of target parameters from the first set and the second set of calculated target parameters using a programmable criteria, and generate frequency lowered auditory cues from the audio input signal using the derived third set of target parameters, wherein the derived third set of target parameters are used in both the first hearing assistance device and the second hearing assistance device for binaurally coordinated frequency lowering.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

BRIEF DESCRIPTION OF THE DRAWINGS

Various embodiments are illustrated by way of example in the figures of the accompanying drawings. Such embodiments are demonstrative and not intended to be exhaustive or exclusive embodiments of the present subject matter.

DETAILED DESCRIPTION

Figure 1:
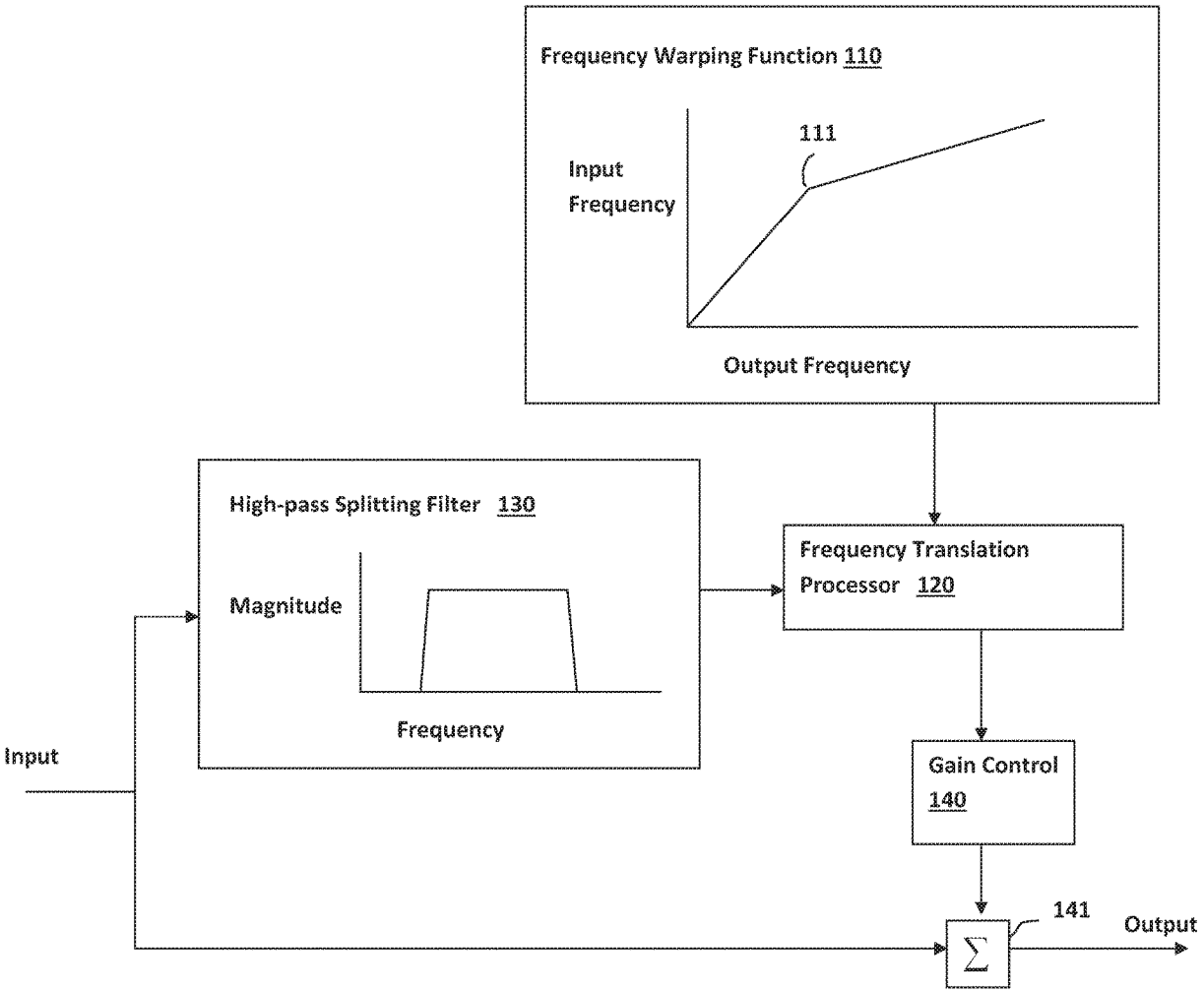
FIG. 1 shows a block diagram of a frequency translation algorithm, according to one embodiment of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

A hearing assistance device provides for auditory correction through the amplification and filtering of sound provided in the environment with the intent that the individual hears better than without the amplification. In order for the individual to benefit from amplification and filtering, they must have residual hearing in the frequency regions where the amplification will occur. If they have lost all hearing in those regions, then amplification and filtering will not benefit the patient at those frequencies, and they will be unable to receive speech cues that occur in those frequency regions. Frequency translation processing recodes high-frequency sounds at lower frequencies where the individual's hearing loss is less severe, allowing them to receive auditory cues that cannot be made audible by amplification.

In previously used methods, each hearing aid processed its input audio to produce an estimate of the high-frequency spectral envelope, represented by a number of filter poles, for example two filter poles. These poles can be warped according to the parameters that are identical (or other parameters that are not identical) in the two hearing aids, but the spectral envelope poles themselves (and therefore also the warped poles) were not identical, due to asymmetry in the acoustic environment. This resulted in binaural inconsistency in the lowered cues (spectral cues at the same time and frequency in both ears). Even if the configuration of the algorithm is the same in the two ears, different cues could be synthesized due to differences in the two the hearing aid input signals.

Disclosed herein, among other things, are apparatus and methods for a binaurally coordinated frequency translation for hearing assistance devices. In various method embodiments, an audio input signal is received at a first hearing assistance device for a wearer. The audio input signal is analyzed, peaks in a signal spectrum of the audio input signal are identified, and a first set of target parameters is calculated for frequency-lowered cues from the peaks. The first set of calculated target parameters is transmitted from the first hearing assistance device to a second hearing assistance device, and a second set of calculated target parameters is received at the first hearing assistance device from the second hearing assistance device. A third set of target parameters is derived from the first set and the second set of calculated target parameters corresponding to a programmable criteria, and a warped spectral envelope (or other frequency lowered audio cue) is generated using the derived third set of target parameters. The derived third set of target parameters is used in both the first hearing assistance device and the second hearing assistance device for binaurally coordinated frequency lowering. In one embodiment, the warped spectral envelope can be used in frequency translation of the audio input signal, and the warped spectral envelope is used in both the first hearing assistance device and the second hearing assistance device for binaurally coordinated frequency lowering.

The present subject matter provides a binaurally consistent frequency-lowered cue, relative to uncoordinated frequency lowering, in noisy environments, in which two uncoordinated hearing aids might derive different synthesis parameters due to differences in the signal received at the two ears. In various embodiments, frequency lowering analyzes the input audio, identifies peaks in the signal spectrum, and from these source peaks, calculates target parameters for the frequency-lowered cues. The present subject matter synchronizes the parameters of the lowered cues between the two ears, so that the lowered cues are more similar between the two ears. This is particularly advantageous in noisy dynamic environments in which it is likely that two uncoordinated hearing aids would synthesize different and rapidly varying spectral cues that could produce an even more dynamic and "busy" sounding experience.

In various embodiments, the initial analysis is performed independently in the two hearing aids, target spectral envelope cue parameters such as warped pole frequencies and magnitudes are transmitted from ear to ear, and the more salient (by some programmable measure) target cue parameters are selected and those same parameters (or other parameters that are derived by some combination of the parameters from the two ears) are applied in both ears. Thus, the present method coordinates the parameters or characteristics of the lowered cues between the two ears, without reducing it to a single diotic (same sound in both ears) cue. Different cues may be synthesized when the hearing aid input signals are different between the two devices. The present subject matter ensures binaural consistency in the lowered cues, or spectral cues at the same time and frequency in both ears, than is possible by simply configuring the algorithm parameters identically in the two hearing aids.

According to various embodiments, spectral envelope parameters which are used to identify high-frequency speech cues and to construct new frequency-lowered cues are exchanged between two hearing aids in a binaural fitting. A third set of envelope parameters is derived, according to some algorithm, and frequency-lowered cues are rendered according to the derived third set of envelope parameters. In one embodiment, from the two sets of envelope parameters, the more salient spectral cues are selected and frequency-lowered cues are rendered according to the selected envelope parameters. Since both hearing aids will have the same two sets of envelope parameters (and since the derivation or saliency logic will be the same in both hearing aids), both hearing aids will select the same envelope parameters as the basis for frequency lowering, enforcing binaural consistency in the processing.

Figure 2:
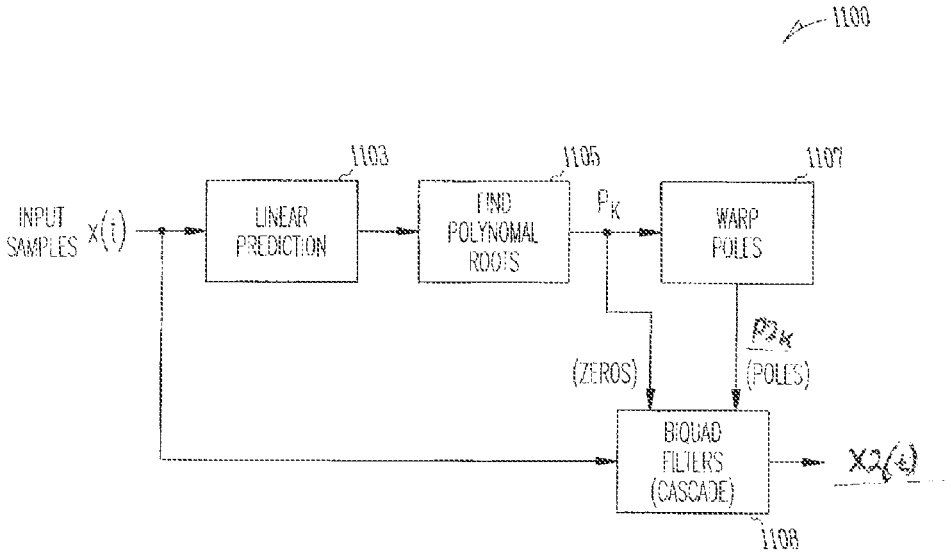
FIG. 2 is a signal flow diagram demonstrating a time domain spectral envelope warping process for the frequency translation system according to one embodiment of the present subject matter.

FIG. 2 is a block diagram of a frequency lowering algorithm, such as the frequency lowering algorithm disclosed in commonly owned U.S. patent application Ser. No. 12/043,827 filed on Mar. 6, 2008 (now U.S. Pat. No. 8,000,487), which has been incorporated by reference herein. In this algorithm, spectral features (peaks) are characterized by finding the roots of a polynomial representing the autoregressive model of the spectral envelope produced by linear prediction. These roots ($P_k$) and the peaks they represent are characterized by their center frequency and magnitude. The roots (or poles) are subjected to a warping function to translate them to lower frequencies, and a new spectral envelope-shaping filter is generated from the combination of the roots before and after warping. The polynomial roots $P_k$ found in block 1105 comprise a parametric description of the high frequency spectral envelope of the input signal. Warping these poles produces a new spectral envelope having the high frequency spectral cues shifted to lower frequencies in the range of aidable hearing for the patient. In the case of a bilateral fitting, both left and right audiometric thresholds can be used to compute the parameters of the warping function. In one example, warping parameters are computed identically for both ears in a bilateral fitting. Other types of fitting algorithms can be used without departing from the scope of the present subject matter.

In the system 1100 of FIG. 2, input samples x(t) are provided to the linear prediction block 1103 and biquad filters (or filter sections) 1108. The output of linear prediction block 1103 is provided to find the polynomial roots 1105, $P_k$. The polynomial roots $P_k$, are provided to biquad filters 1108 and to the pole warping block 1107. The roots $P_k$ specify the zeros in the biquad filter sections. The resulting output of pole warping block 1107, $P2_k$, is applied to the biquad filters 1108 to produce the warped output x2(t). The warped roots $P2_k$ specify the poles in the biquad filter sections. It is understood that the system of FIG. 3 can be implemented in the frequency domain. Other frequency lowering variations are possible without departing from the scope of the present subject matter.

In previous methods, each hearing aid processed its input audio to produce an estimate of the high-frequency spectral envelope, represented by two filter poles. These poles were warped according to the parameters that were identical in the two hearing aids, but the spectral envelope poles themselves (and therefore also the warped poles) were not identical, due to asymmetry in the acoustic environment.

In the present subject matter, the hearing aids exchange the spectral envelope parameters (pole magnitudes and frequencies) and select the parameters corresponding to the more salient speech cues, so that not only the warping parameters but also the peaks (or poles) in the warped spectral envelope filter are identical in the two hearing aids. The logic by which the more salient envelope parameters are selected can be as simple as choosing the envelope having the sharper (higher pole magnitude) spectral peaks, or it could more something more sophisticated. Any kind of logic for selecting or deriving the peaks (or poles) in the warped spectral envelope filter from the exchanged envelope parameters can be included in the scope of the present subject matter. Likewise, any parameterization of the spectral cues in a frequency-lowering algorithm can be included in the scope of present subject matter.

In previous methods, the warped pole magnitudes and frequencies were smoothed in time to produce parameters for the frequency-lowered spectral cues that were then synthesized. This temporal smoothing stabilized the cues, and ensured that artifacts from rapid changes in the synthesis parameters did not degrade the final signal. Within the scope of present subject matter, spectral envelope parameters can be exchanged either before or after the warping process, and, if after warping, the warped pole parameters could be exchanged either before or after smoothing (but note that these different embodiments can produce different results).

In various embodiments of the present subject matter, the hearing aids exchange the spectral envelope pole magnitudes and frequencies, and these exchanged estimates can be integrated into the smoothing process to prevent artifacts and parameter discontinuities being introduced by the synchronization process. Specifically, binaural smoothing can be introduced, such that the most salient spectral cues from both ears are selected to compute the target parameters in both hearing aids, and these shared targets are smoothed (over time) before final synthesis of the lowered cues. Binaural smoothing is most useful when spectral envelope parameters are exchanged asynchronously or at a rate that is lower than the block rate (one block every eight samples, for example) of core signal processing. Since the hearing aids may not always exchange data synchronously, or at the high rate of signal processing, the far-ear parameters can be stored and reused in successive signal processing blocks, for purposes of binaural smoothing, and updated whenever new parameters are received from the other hearing aid.

In various embodiments, any frequency lowering algorithm that operates by rendering lowered cues parameterized according to analysis of the input signal can support the proposed binaural coordination, by exchanging analysis data between the two hearing aids and integrating the two sets of data according to a process similar the binaural smoothing described herein.

If the proposed binaural synchronization would be applied to a distortion-based frequency lowering process such as frequency compression (see, for example, C. W. Turner, and R. R. Hurtig, "Proportional frequency compression of speech for listeners with sensorineural hearing loss," *Journal of the Acoustical Society of America,* 106, 1999, pp. 877-886), the compressed and coordinated cues (or compressed cues to be coordinated between the two hearing aids) can be described by a set of parameters abstracted from the audio. For example, the magnitude difference between the lowered and unprocessed spectra can be parameterized (as peak coefficients or a spectral magnitude response characteristic, like a digital filter) and this parametric description shared and synchronized between the two hearing aids.

According to various embodiments, after coordinating the translated cues between the two ears, spatial processing can be applied to them, reflecting the direction of the source. For example, if the speech source is positioned to the left of the listener, then, after unifying the parameters for the lowered cues in the two aids, binaural processing (for example, attenuation or delay in one ear) may be applied to cause the translated cues to be perceived as coming from the same direction (for example, to the left of the listener) as that of the speech source.

An example of a bilateral fitting rationale includes the subject matter of commonly-assigned U.S. patent application Ser. No. 13/931,436, titled "THRESHOLD-DERIVED FITTING METHOD FOR FREQUENCY TRANSLATION IN HEARING ASSISTANCE DEVICES", filed on Jun. 28, 2013, which is hereby incorporated herein by reference in its entirety. FIG. 1 shows a block diagram of a frequency translation algorithm, according to one embodiment of the present subject matter. The input audio signal is split into two signal paths. The upper signal path in the block contains the frequency translation processing performed on the audio signal, where frequency translation is applied only to the signal in a highpass region of the spectrum as defined by highpass splitting filter 130. The function of the splitting filter 130 is to isolate the high-frequency part of the input audio signal for frequency translation processing. The cutoff frequency of this highpass filter is one of the parameters of the algorithm, referred to as the splitting frequency. The frequency translation processor 120 operates by dynamically warping, or reshaping the spectral envelope of the sound to be processed in accordance with the frequency warping function 110. The warping function consists of two regions: a low-frequency region in which no warping is applied, and a high-frequency warping region, in which energy is translated from higher to lower frequencies. The input frequency corresponding to the breakpoint in this function, dividing the two regions, is called the knee frequency 111. Spectral envelope peaks in the input signal above the knee frequency are translated towards, but not below, the knee frequency. The amount by which the poles are translated in frequency is determined by the slope of the frequency warping curve in the warping region, the so-called warping ratio. Precisely, the warping ratio is the inverse of the slope of the warping function above the knee frequency. The signal in the lower branch is not processed by frequency translation. A gain control 140 is included in the upper branch to regulate the amount of the processed signal energy in the final output. The output of the frequency translation processor, consisting of the high-frequency part of the input signal having its spectral envelope warped so that peaks in the envelope are translated to lower frequencies, and scaled by a gain control, is combined with the original, unmodified signal at summer 141 to produce the output of the algorithm.

The output of the frequency translation processor, consisting of the high-frequency part of the input signal having its spectral envelope warped so that peaks in the envelope are translated to lower frequencies, and scaled by a gain control, is combined with the original, unmodified signal to produce the output of the algorithm, in various embodiments. The new information composed of high-frequency signal energy translated to lower frequencies, should improve speech intelligibility, and possibly the perceived sound quality, when presented to an impaired listener for whom high-frequency signal energy cannot be made audible.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), invisible-in-canal (IIC) or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A system, comprising:

a first hearing device configured to be worn in or on a first ear of a wearer, wherein the first hearing device includes a first processor programmed to:

receive a first audio input signal, and determine a first set of spectral envelope parameters from the first audio input signal;

receive a second set of spectral envelope parameters from a second hearing device configured to be worn in or on a second ear of the wearer;

process the first set of spectral envelope parameters and the second set of spectral envelope parameters using a programmable criteria to derive a third set of spectral envelope parameters used to generate frequency lowered audio cues for binaurally coordinated frequency lowering;

process the first audio input signal using the third set of spectral envelope parameters to obtain a first audio output signal; and output the first audio output signal at the first ear using a first receiver, wherein the second hearing device includes a second processor programmed to:

receive a second audio input signal, and determine the second set of spectral envelope parameters from the second audio input signal;

receive the first set of spectral envelope parameters from the first heating device;

process the first set of spectral envelope parameters and the second set of spectral envelope parameters using the programmable criteria to derive the third set of spectral envelope parameters, including using binaural smoothing to prevent artifacts;

process the second audio input signal using the third set of spectral envelope parameters to obtain a second audio output signal; and output the second audio output signal at the second ear using a second receiver.

2. The system of claim 1, wherein the first set of spectral envelope parameters includes a first spectral envelope pole magnitude.

3. The method of claim 1, wherein the first set of spectral envelope parameters includes a first spectral envelope pole frequency.

4. The system of claim 1, wherein the second set of spectral envelope parameters includes a second spectral envelope pole magnitude.

5. The method of claim 1, wherein the second set of spectral envelope parameters includes a second spectral envelope pole frequency.

6. The system of claim 1, wherein at least one of the first hearing device and the second hearing device includes a hearing aid.

7. The system of claim 6, wherein the hearing aid includes an in-the-ear (ITE) hearing aid.

8. The system of claim 6, wherein the hearing aid includes a behind-the-ear (BTE) hearing aid.

9. The system of claim 6, wherein the hearing aid includes an in-the-canal (ITC) hearing aid.

10. The system of claim 6, wherein the hearing aid includes a receiver-in-canal (RIC) hearing aid.

11. The system of claim 6, wherein the hearing aid includes a completely-in-the-canal (CIC) hearing aid.

12. A method, comprising:

receiving a first audio input signal at a first hearing device for a first ear of a wearer, and receiving a second audio input signal at a second hearing device for a second ear of the wearer;

determining a first set of spectral envelope parameters from the first audio input signal at the first hearing device using a first processor, and determining a second set of spectral envelope parameters from the second audio input signal at the second hearing device using a second processor;

receiving the first set of spectral envelope parameters at the second hearing device, and receiving the second set of spectral envelope parameters at the first hearing device;

using the first processor and the second processor to process the first set of spectral envelope parameters and the second set of spectral envelope parameters using a programmable criteria to derive a third set of spectral envelope parameters used to generate frequency lowered audio cues for binaurally coordinated frequency lowering, including using binaural smoothing to prevent artifacts;

using the first processor to process the first audio input signal using the third set of spectral envelope parameters to obtain a first audio output signal; and using the second processor to process the second audio input signal using the third set of spectral envelope parameters to obtain a second audio output signal.

13. The method of claim 12, wherein determining the first set of spectral envelope parameters includes identifying first peaks in a signal spectrum of the first audio input signal.

14. The method of claim 12, wherein determining the second set of spectral envelope parameters includes identifying second peaks in a signal spectrum of the second audio input signal.

15. The method of claim 13, wherein using the programmable criteria includes using magnitude of the identified first peaks.

16. The method of claim 14, wherein using the programmable criteria includes using magnitude of the identified second peaks.

17. The method of claim 12, further comprising storing the second set of spectral envelope parameters at the first hearing device.

18. The method of claim 17, further comprising reusing the stored second set of spectral envelope parameters in successive signal processing blocks at the first hearing device.

19. The method of claim 18, further comprising updating the stored second set of spectral envelope parameters at the first hearing device when new parameters are received from the second hearing device.

20. The method of claim 12, wherein the first and second processor are programmed to, after coordinating translated cues between the two ears, apply spatial processing to reflect a direction of a source to cause the translated cues to be perceived as coming from the direction.

* * * * *